United States Patent [19]

Kramer

[11] 3,973,767

[45] Aug. 10, 1976

[54] METHOD AND APPARATUS FOR FEEDING SHEET MATERIAL

[76] Inventor: Lawrence I. Kramer, 532 Cherry Drive, Dayton, Ohio 45405

[22] Filed: Nov. 18, 1974

[21] Appl. No.: 524,530

[52] U.S. Cl. ..... 271/12; 214/8.5 D; 271/100; 271/272; 271/275

[51] Int. Cl.[2] ..... B65H 3/08; B65H 5/02; B65H 5/06

[58] Field of Search ..... 271/11, 12, 13, 100, 271/99, 101, 102, 107, 113, 272, 273, 274, 275; 214/8.5 D; 198/130

[56] References Cited

UNITED STATES PATENTS

| | | | |
|---|---|---|---|
| 2,262,798 | 11/1941 | Elliott | 271/100 X |
| 2,748,971 | 6/1956 | Flynn | 271/100 X |
| 2,770,458 | 11/1956 | Halahan et al. | 271/99 |
| 3,121,490 | 2/1964 | Rainbow | 198/130 |
| 3,424,452 | 1/1969 | Jones | 271/100 |

FOREIGN PATENTS OR APPLICATIONS

| | | | |
|---|---|---|---|
| 447,074 | 7/1927 | Germany | 271/100 |

*Primary Examiner*—Evon C. Blunk
*Assistant Examiner*—Bruce H. Stoner, Jr.
*Attorney, Agent, or Firm*—Robert L. Deddens

[57] ABSTRACT

An endless belt is supported in apparatus adjacent a wheel, and at least a portion of the belt wraps around and is in driving communication with the wheel. A head supplied with a source of negative pressure pivots in timed relation with the belt, which is movable on the perimeter of the wheel, and operates to deflect the lowermost product of a stack of flat, flexible sheet-like products to a point adjacent the wheel. When the sheet is in its deflected position adjacent the wheel, the belt is actuated to move and engage the sheet to cause the sheet to be extracted from the stack between the belt and the wheel and to be fed away from the stack. The apparatus automatically adjusts to a wide variation in the thickness of the product being fed.

11 Claims, 7 Drawing Figures

METHOD AND APPARATUS FOR FEEDING SHEET MATERIAL

BACKGROUND OF THE INVENTION

The present invention relates to a method and apparatus for feeding flexible sheet-like articles singly from a stack at rest in a hopper. The articles could be items such as cards, checks, labels, envelopes, books, booklets, pamphlets, pads, folded paper products and the like.

There is a need for better means to perform the basic elements of the feeding operation which consist of (1) separating one article from a stack of articles (2) setting the article in motion away from the stack, and (3) engaging the article in a transport system.

The change of state of an article at rest in a stack to a state of uniform motion in a transport system demands an effective means to impart high accelleration force to the article in order to avoid inaccuracies in the positions of the article in a transport system. The higher the speeds the more difficult it is to accomplish such accurate feeding. Prior art associated with this difficulty has not met the demand for higher speeds and better accuracy.

SUMMARY OF THE INVENTION

The present invention is directed to an improved method and apparatus for feeding sheet material of the type disclosed, and in particular for providing a novel means to set sheet-like articles in motion away from a stack of articles at very high speeds with exceptionally accurate positioning in a transport system.

The invention provides accurately controlled gripping engagement between an endless elastic belt moving over a set of rollers and a rotational wheel driven by the belt. In accordance with a preferred embodiment, the apparatus includes a belt carried by a system of rollers enabling the belt to wrap around a portion of a wheel. The apparatus is designed to pivot in a manner to shift the belt further around the wheel with no appreciable stretch nor change in the overall length of the belt. Said pivotable motion provides a controlled feeding means.

The lowermost article in the stack is deflected down to a position adjacent the wheel and, when the belt is shifted around the wheel, the belt effectively engages the deflected article between the belt and the wheel. An exceptionally high frictional force effects a gripping of the article and accellerates tha article at a speed corresponding to the controlled rotation speed of the belt and wheel.

Since the roller addressing the belt to the wheel also pivots in its holding apparatus, and the belt has some elasticity, the engaging grip upon tha article is consistently effective even though the thickness of the product may vary considerably.

The apparatus incorporates a suction head communicating with an arm, wherein the arm is pivoted about a point on the same level (or slightly above) the bottom of the stack of sheet material. This geometric relationship enables the suction head to rotate on the same radius as the deflected article and eliminates undesirable lateral forces between the head and the article being fed such as encountered in conventional feeding apparatus where the suction head is pivoted below the stack.

DETAILED DESCRIPTION OF THE PREFERRED EMBODIMENT

Figure 1:
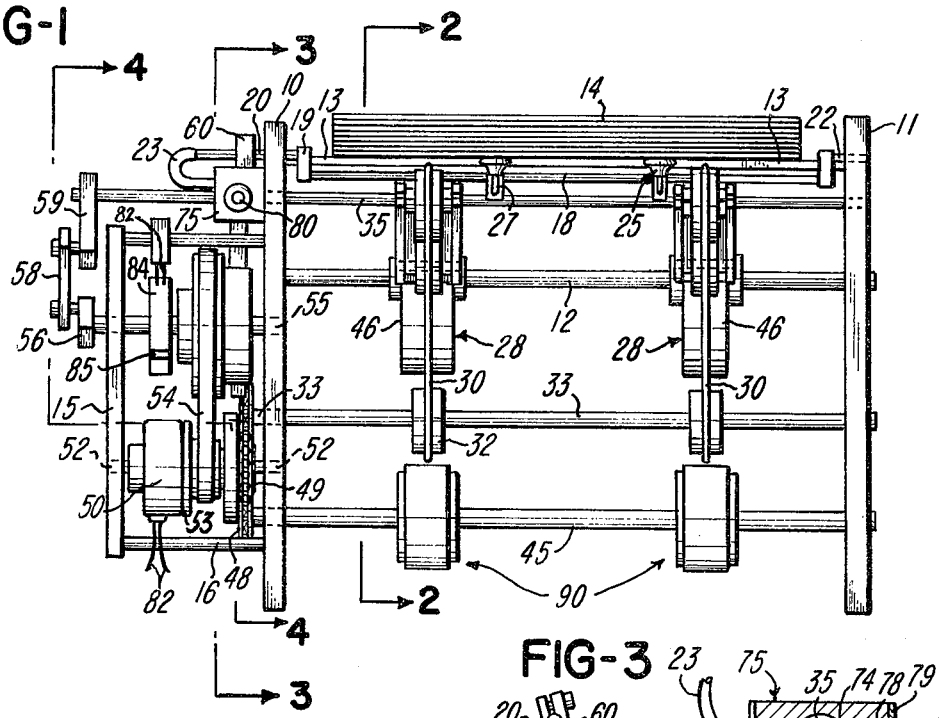
FIG. 1 is an end view of the feeding apparatus of the present invention showing the suction head and gripping mechanism thereof addressing a stack of product items, and showing the actuating mechanisms thereof adjacent the assembly.

Referring to the drawings, and particularly to FIG. 1, the apparatus is mounted on a frame including two side members 10 and 11 which are fastened to a number of equal length cross bars such as bar 12 rigidly holding the side members in spaced-apart parallel relation to one another. A hopper support plate 13 is rigidly fastened to the side members 10 and 11 and supports a stack of product items 14, such as pamphlets, booklets or the like. To provide support for mechanisms which actuate the apparatus, a plate 15 is fastened to the left side member 10 by a number of cross bars 16.

A tubular shaft 18 is rigidly mounted at each end in a tubular arm 19. Adjacent side member 10, the arm 19 is connected to a short tubular shaft 20 while adjacent side member 11 the other arm 19 is connected to a solid shaft 22, the shafts 20 and 22 being rotatably mounted in the side members 10 and 11 respectively.

The shaft 18 is connected to a source of negative pressure via the flexible tube 23 and transmits negative pressure to a pair of suction heads 25 rigidly mounted on the shaft 18. Each suction head 25 (FIG. 2) includes a flexible cup or nipple portion 26 with a V-shaped tubular stem connection 27 formed such that the nipple portion 26 addresses the bottom of the stack 14 near the end thereof. When negative pressure is applied, the heads 25 will positively engage the lowermost product in the stack. As shown in FIG. 1, the shafts 20 and 22 are generally coplanar with the bottom of the stack 14 and, as will be more fully explained hereinafter, enable the nipple portion 26 and the lowermost product in the stack to pivot on the same arc.

Figure 2:
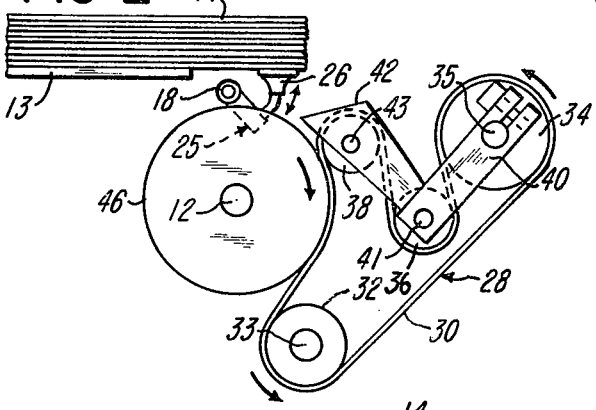
FIG. 2 is a view of the gripping portion of the apparatus in its "no-feed" position taken along line 2—2 in FIG. 1.

Gripping apparatus is provided for acting cooperatively with the suction heads 25. Referring to FIG. 2, each gripper 28 includes a resilient belt 30 driven by a drive roller 32 rotatably mounted on a shaft 33. The belt 30 is stretched around an idle roller 34 rotatably mounted on a shaft 35, bearing mounted in the frame members 10 and 11 (see FIG. 1), and also around a pin-mounted take-up roller 36 and a pin-mounted gripper roller 38. The drive roller 32 and idle roller 34 rotate in stationary positions, whereas the take-up roller 36 and gripper roller 38 are movable, through linkage action, in response to rotary displacement of shaft 35. The linkage includes a first pair of arms 40 rigidly clamped at one end thereof to the shaft 35 and pin mounted at the other end on the take-up roller pin 41, and a second pair of arms 42 mounted at one end thereof on the take-up roller pin 41 and at the other end thereof on the gripper roller pin 43.

The gripping apparatus addresses the feed wheel 46 so that the gripper belt 30 wraps over a portion of the periphery of the feed wheel 46 (see FIG. 2). Tension in the gripper belt 30 causes the gripper roller 38 to be held down upon the feed wheel 46, and belt 30 is placed in frictional engagement with the feed wheel 46.

Figure 3:
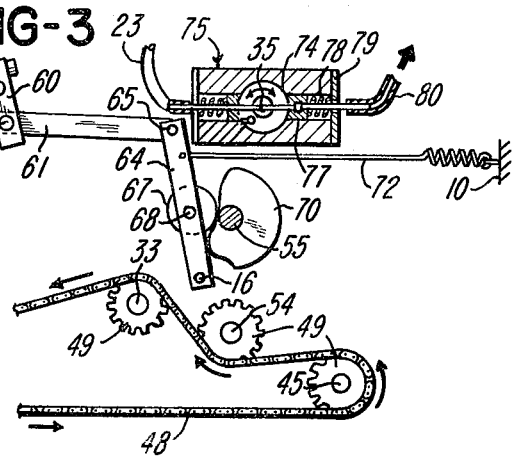
FIG. 3 is a sectional view taken generally along line 3—3 in FIG. 1, showing the mechanism for actuating the suction heads showing the chain drive and sprockets which impart rotation to the gripping belt apparatus as well as to the transport system, and showing the valving apparatus controlling the suction to the suction heads.
Figure 4:
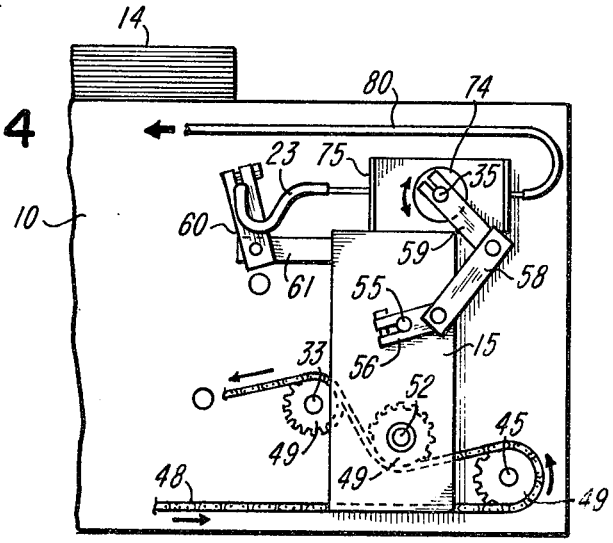
FIG. 4 is a broken-away side elevation of the mechanism for actuating the gripper rollers and the suction control valve, taken along line 4—4 in FIG. 1.
Figure 5:
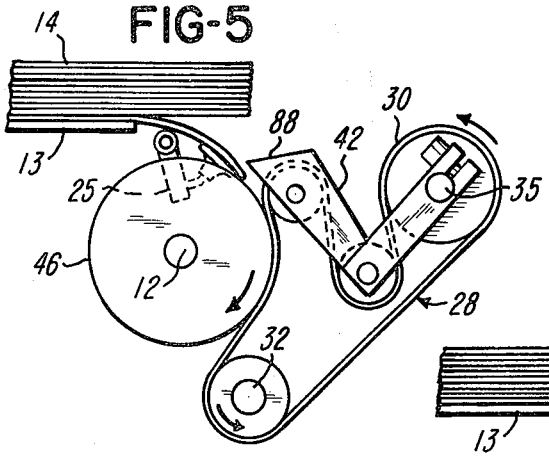
FIG. 5 is a view of the gripping portion of the apparatus in FIG. 2 in its "product-separated" position.

Referring to FIGS. 1, 3 and 4, mechanisms are provided for actuating the grippers 28. Shafts 33 and 45 are rotatably mounted on side members 10 and 11 (FIG. 1) and are rotated by a chain 48 (FIGS. 3 and 4) carried by a series of sprockets 49 and driven by a source (not shown). Rotation of shaft 33 causes roller 32 to move the belt 30 in the counterclockwise direction and to frictionally drive the feed wheel 46 in a clockwise direction (FIG. 2).

A clutch 50 (FIG. 1) on shaft 52 is adapted, when energized, to engage an armature plate 53 to cause the pulley belt 54 on the shaft 52 to transmit the rotation of shaft (also driven by chain 48) to shaft 55. In turn, the crank arm 56 (rigidly clamped to shaft 55) rotates and, through linkage arms 58 and 59, imparts an angular displacement or rotation to idle roller shaft 35 which extends through member 10. The configuration of the linkage is such that a 360° rotation of shaft 52 causes only an angular displacement of shaft 35. An angular displacement of shaft 35 in the clockwise direction causes the roller 38 to move up to wrap belt 30 around a greater portion of wheel 46.

The suction heads 25 are actuated as follows: The tubular shaft 20 extends through side member 10 where it carries an arm 60 (FIGS. 1 and 3) rigidly clamped thereto. Link 61 is pivotally connected to arm 60 by pin 62 and to bracket 64 by pin 65. The bracket 64 is pivotally mounted on a cross bar post 16 (not shown in FIG. 1). a cam roller 67 mounted on bracket 64 by pin 68 addresses a cam 70 rigidly mounted on shaft 55. A spring 72 connects to bracket 64 and is anchored on frame member 10 to hold roller 67 against cam 70. Rotation of shaft 55 actuates the linkage connection with shaft 20 and rotates shaft 20 in controlled motion in accordance with the rise and fall designed into the cam 70. The linkage configuration is such that one 360° revolution of shaft 55 causes an angular displacement of shaft 18 in the clockwise direction (FIG. 2), causing the nipple portion 26 to pivot toward the wheel 46.

To control the negative pressure, a vacuum-control valve rotor 74 is adapted to communicate a negative pressure to the suction heads 25 in timed relation to the rotation of shaft 35. Affixed to shaft 35, the rotor is free to rotate in a valve housing 75 fastened to side member 10. Valve port seats 77 are held against rotor 74 by springs 78 and retained by plates 79. A negative air pressure source (not shown) is conducted to the valve port seat through a flexible tube 80. It can be seen that rotation of shaft 35 alters the angular position of the port holes in rotor 74 and controls the "on-off" negative pressure to the suction heads 25 via the flexible tube 23.

With suitable electric control apparatus, electrical energy can be delivered through wires 82 (FIG. 1) to clutch 50 to impart rotation from shaft 52 to shaft 55. When this occurs, shaft 55 activates the grippers 28 via shaft 35 and the suction heads 25 via shaft 18 in controlled motions where one rotation of 360° of shaft 55 effects one gripper cycle as well as one suction head cycle.

Cycle stop switch disc 84 is rigidly affixed to shaft 55 and carries a conductor bar 85 designed to make "on" connection between wires 82 to initiate a cycle stop by conducting an electrical impulse signal to the electrical control system. The electric control apparatus stops the energy supply to clutch 50, and spring 72 pulls roller 67 into a detent position in cam 70 as shown in FIG. 3, and the cycle stops.

Referring to FIGS. 2, 5, 6 and 7, the feeding system is further described. In the "no-feed" position (FIG. 2) roller shaft 33 is rotating counterclockwise and the gripper belt 30 rotates rollers 34, 36, and 38 as well as feed wheel 46. The product stack 14 is at rest on hopper base 13. Sucker members 25 are addressed to the bottom most product in said stack. A negative air pressure is transmitted from its source to sucker members 25 which engage a hold on the bottom forward surface of lowermost product in stack 14. The negative air pressure is transmitted to the members 25 via the channels in the rotor 74 and shaft 18.

A feed cycle is initiated when electrical energy from the electric control system causes the clutch 50 to transmit the rotary motion of shaft 52 to shaft 55. Cam 70 then displaces and rotates shaft 18 causing the suckers 25 to move from the position shown in FIG. 2 to the position shown in FIG. 5. Since suction heads 25 have negative air pressure engagement with the lowermost sheet in stack 14, this product is deflected downwardly to the periphery of feed wheel 46 (FIG. 5) where its forward ends are separated from the stack.

As shaft 55 continues its rotation cam 70 causes the shaft 18 to rotate and at the same time shaft 35 rotates (see FIG. 4). This movement causes the pressure rotor to move to a point where the negative pressure source to suction heads 25 is disconnected and the heads 25 release their engagement with the deflected sheet. This same rotation of shaft 35 moves the gripper roller linkage to a position illustrated in FIG. 5 where fingers 42 are located above and physically retain the deflected sheet in a "ready-to-feed" position.

Figure 6:
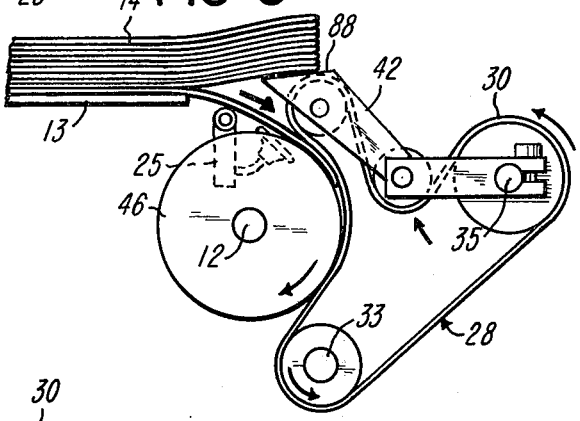
FIG. 6 is a view of the gripping portion of the mechanism apparatus in FIG. 2 in its "start-feed" position.

As shaft 55 continues its rotation, cam roller 67 rides on the uniform radius of cam 70, the suction head linkage is held at rest, and suction head 25 remains in the retracted position shown in FIG. 6. Crank arm 56 rotates and in the process shaft 35 rotates and actuates the suction head linkage to move the gripper roller 38 up the periphery of feed wheel 46. With the movement, the roller 38 rolls over the deflected product item, gripping the item frictionally between gripper belt 30 and feed wheel 46 and, since the belt 30 and feed wheel 46 are in motion, sets the item in motion.

As fingers 42 move from the "ready-to-feed" position (FIG. 5) to the "feed" position (FIG. 6) the end portions 88 engage the bottom of the remaining product items and lift the stack somewhat to assist in the separation as well as the feed of the lowermost product from the stack, by supporting some of the stack weight to reduce the force required to remove the lowermost item from the stack.

Movement of the gripper apparatus causes negligible change in length of belt 30, because the increased wrap-around of belt 30 on the periphery of feed wheel 46 is designed to be nearly exactly the same as the decrease in the length of belt in the loop made by take-up roller 36 between gripper roller 38 and idle roller 34. Tension in belt 30 not only holds belt 30 taut against feed wheel 46, but also gives gripper roller 38 a spring-like force toward the feed wheel 46. This spring-like force allows the gripper roller 38 to travel over and engage a relatively wide range of thickness of products.

It can be seen that as shaft 33 is in continuous counterclockwise rotation (FIG. 2) roller 32 drives belt 30 in a counterclockwise movement, which in turn drives feed wheel 46 in clockwise rotation at the same surface speed as belt 30. A product engaged between belt 30 and feed wheel 46 will be moved away from stack 14 at the same speed as the belt 30.

Figure 7:
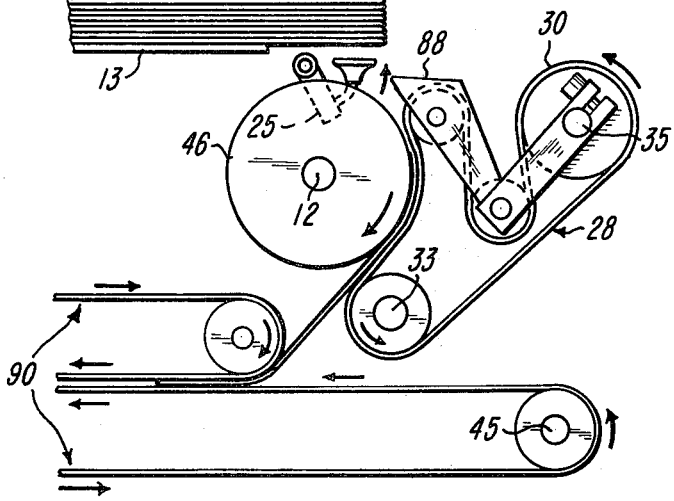
FIG. 7 is a view of the gripping portion of the apparatus in FIG. 2 in its "completed feed" position.

As the cycle proceeds, the rotation of shaft 55 will move crank arm 56 and the gripper apparatus will move back toward its start position (FIG. 2). As shaft 35 rotates negative pressure control valve rotor 74 will move and negative pressure will be delivered to suction heads 25. Through this movement the product will continue to travel at the speed of belt 30 to a transport system 90 (FIG. 7). The rotation of shaft 55 will likewise rotate cam 70 through a position in which the cam roller falls, causing the linkage to shaft 18 to rotate suction heads 25 back up toward the next lowermost product in stack 14 (FIG. 7)

As shaft 55 approaches completion of a 360° cycle rotation, the cycle stop switch disc 84 will rotate to a position in which the conductor bar 85 will close an electric circuit by contacting wires 82 to provide an impulse signal to the electrical control system. The system is adapted to stop the supply of electrical energy to clutch 50, and shaft 55 will become disengaged from the rotation of shaft 52. At this instant cam roller 67 will be pulled by the energy from spring 72 to fall into detent position in cam 70. Thus the feeding action will be stopped, but the apparatus will be in a condition to accomplish a subsequent feed cycle whenever another electrical impulse signal to the control system causes it to send energy to clutch 50.

The drawings and foregoing descriptions explain how this novel feeding apparatus can accomplish demand feeding of a product with an electrical control system upon impulse signals sending electric energy to a suitable clutch and suitable actuating mechanism. Other actuating mechanisms, such as pneumatic, hydraulic, or mechanical, could accomplish control of actuation of the gripper apparatus of the invention as well. A primary advantage of the novel gripper apparatus is that it can be controlled by a selection of means.

The mechanical action of the gripper apparatus involves simple continuous rotation of a drive shaft such as shaft 33 to impart simple rotating motion to a flexible belt, such as belt 30, over a series of rotating rollers, to effect rotating motion of a feed wheel 46. The gripper system is activated by simple rotary displacement of the shaft 35.

A product is deflected or separated from the stack by movable suction heads 25. This apparatus is actuated by simple rotary displacement of shaft 18. The invention does, however, depart from convention in that the shaft 18 is off-set (see FIG. 1) so that its pivot point is on the same level as the bottom of the stack. This avoids rotation of the shaft on a different radius from that of the deflected product, and avoids undesirable lateral forces between the suction heads and the product.

From the foregoing description, it can be seen that the present invention provides novel apparatus for activating and controlling the movement of a product into a processing operation, in which:

1. information is transferred to the product, where it is printed upon, punched, or treated with energy.
2. information is read from the product, such as raw data for computors, to accomplish counting, tabulating, or sorting.
3. the product is converted in form, such as die cut, folded, or otherwise processed.
4. the product is fabricated, affixed to, or otherwise co-related with some other product.
5. the product is prepared for mailing, shipping, stamping or stamp cancellation.
6. the product is wrapped or packaged.

The present invention provides unique control features in the feeding function. It regulates the feed by a demand signal, such as an electrical impulse, so that the product can be moved in a time-position relationship with some other function, whether that function is operating on uniform repeat cycles, intermittent cycles, or irregular cycles, or varying speed cycles. It also regulates the feed to repeat its time-position relationship with some other operation or cycle, or to vary its time-position relationship with the operation according to some predetermined program. The invention provides a unique control feature in the feeding function so that a mechanical interlocking mechanism can exactly control synchronized repeat time-position movement of the product with other operation cycles.

In addition, the invention provides unique control features in the feeding function so that "on-feed" and "off-feed" can be accomplished at ultra high speeds with suitable demand signals. This makes the apparatus especially well suited for operations involving batch counting, sorting, and to selecting "yes" and/or "no" responses relating to other specific operations— to make any variety of selective, intermittent, or programmed feeding practical.

Another feature of the invention is the novel gripper action means for gaining control and accelerating the product with an exact time-position movement to a transport system to accomplish ultra high speed precision feeding. The novel gripper action means exerts great excelleration forces on the product which can effectively remove it from the bottom of a relatively heavy stack of products. Moreover, the novel gripper action means automatically adjusts to relatively wide variations in the thickness of products.

The unique frictional grip between the feed wheel and the feed belt can be increased significantly by increasing the tension in the belts. The greater the belt tension the greater the force with which the gripper rollers will hold the feed belt down upon the feed wheel where initial engagement is effected. The more the belt tension the stronger will be the rotational driving force applied to the belt and to the feed wheel. In addition, the grip can be improved by selecting belts especially designed for high frictional properties, including treaded belts, by applying high frictional surface material to the circumference of the feed wheel, and by increasing the number of belts in the feeder apparatus.

The belts require very little space and could be spaced less than ¼ inch apart. For example, 40 or more belts could be employed to remove 8 ½ inches by 11 inches articles from a stack.

It can be seen that the more an article resists removal from the stack, the greater the force of the belt pull will pull the gripper roller down upon the article to squeeze it against the feed wheel. The force of the belt assists the gripper roller to climb up over a relatively thick article.

The preferred embodiment employs an elastic belt. It should be seen that the flexing function of the belt could be attained by other means, such as a spring loaded idler roller applied against belt 30. Such a roller would create the designed feeding tension and also provide a "give" for accommodating articles of varying thickness.

Another feature of the invention is that the novel gripper means is formed to hold the deflected edge of a lowermost product in a stack in a separated "ready-to-feed" position after negative pressure is released from the suction heads. The suction apparatus is rotatable about a pivot point in line with the exact bottom of the hopper, rather than not below, so that the heads and the deflected products will swing an exact same arc.

Another feature of the invention provides means to regulate negative pressure in order that the suction heads will engage products in their "up" position, and control the product through rotary displacement motion down to a "ready-to-feed" position, then release the product at the instant in the cycle that the gripper apparatus engages the product. In addition, the feeder apparatus can be controlled by various control actions, singularly or in combination: (1) by regulating the source of negative pressure to the suction heads, (2) by regulating movement of the suction heads, and/or (3) by regulating movement of the gripper apparatus.

It should be obvious that the apparatus can be operated with one or more sets of suction heads and grippers. The invention should not be limited because two sets thereof are shown in the drawings.

While the method and form of apparatus herein described constitutes preferred embodiments of the invention, it is to be understood that the invention is not limited to this precise method and form of apparatus, and that changes may be made therein without departing from the scope of the invention which is defined in the appended claims.

What is claimed is:

1. A method for successively feeding flexible sheet-like articles from a supply stack, comprising the steps of rotating a wheel spaced from the lowermost article in the stack, driving an endless belt with a portion thereof extending at least partially around the wheel and thereby driving the wheel, addressing an end portion of the lowermost article in the stack to a position adjacent the wheel, shifting the belt around the wheel between a non-gripping position spaced from the lowermost article and a gripping position engaging the lowermost article to frictionally engage the lowermost article between the belt and the wheel and thereby pull and feed the lowermost article from the stack.

2. Apparatus for successively feeding flexible sheet-like articles from a supply stack, comprising means for supporting the supply stack of articles, a rotatable wheel spaced from the lowermost article in the stack, an endless belt positioned adjacent said wheel and having a portion thereof extending at least partially around the periphery of said wheel, means for driving said belt and said wheel, means for positioning an end portion of the lowermost article in the stack adjacent said wheel, means for shifting said belt circumferentially around the periphery of said wheel between a non-gripping position spaced from said article and a gripping position overlapping said article, said shifting means including a gripper roller rotatably mounted on a movable shaft adjacent said wheel, an idle roller rotatably mounted on a rotatable shaft, a take-up roller rotatably mounted on a movable shaft intermediate said gripper roller and said idle roller, articulated linkage means connecting said shaft for said idle roller to said shaft for said take-up roller and said shaft of said take-up roller to said shaft of said gripper roller, means for imparting rotary motion to said idle roller shaft causing said linkage means to move said gripper roller between said nongripping position and said gripping position, and wherein said belt is arranged on said rollers to move therewith, and said shifting means being effective to cause said belt to move toward said article and thereby frictionally engage said article between said belt and said wheel for pulling and feeding said article from the stack.

3. Apparatus for successively feeding flexible sheet-like articles from a supply stack, comprising means for supporting the supply stack of articles, a rotatable wheel spaced from the lowermost article in the stack, an endless belt positioned adjacent said wheel and having a portion thereof extending at least partially around the periphery of said wheel, means for driving said belt and said wheel, means for positioning an end portion of the lowermost article in the stack adjacent said wheel, means for shifting said belt circumferentially around the periphery of said wheel between a non-gripping position spaced from said article and a gripping position overlapping said article, and said shifting means being effective to cause said belt to move toward said article and thereby frictionally engage said article between said belt and said wheel for pulling and feeding said article from the stack.

4. Apparatus as defined in claim 3 wherein said shifting means is effective to cause the tension in said belt to increase when said belt is shifted from said non-gripping position to said gripping position to assure positive feeding of the lowermost article from the stack.

5. Apparatus for successively feeding flexible sheet-like articles from a supply stack supported in a hopper, comprising a rotatable wheel spaced from the lowermost article in the stack, an endless belt positioned adjacent said wheel having a portion thereof extending at least partially around the periphery of said wheel, means for driving said belt and said wheel, means for positioning an end portion of the lowermost article in the stack adjacent said wheel, means for shifting said belt circumferentially around the periphery of said belt between a non-gripping position spaced from said article and a gripping position overlapping at least the end portion of said article, said shifting means including a gripper roller rotatably mounted on a movable shaft adjacent said wheel, with said belt being arranged on said roller to move therewith, and said shifting means further including means for moving said gripper roller and belt circumferentially around the periphery of said wheel to cause said belt to move toward said article and thereby cause frictional engagement of said article between said belt and said wheel for pulling and feeding said article from the stack.

6. Apparatus for successively feeding flexible sheet-like articles from a supply stack, comprising means for supporting the supply stack of articles, a plurality of rotatable wheels spaced from the lowermost article in the stack, a plurality of endless belts, each positioned adjacent a corresponding wheel and having a portion thereof extending at least partially around the periphery of each said wheel, means for driving said belts and said wheels, means for positioning an end portion of the lowermost article in the stack adjacent said wheels, means for simultaneously shifting said belts circumferentially around the periphery of said wheels between non-gripping positions spaced from said article and gripping positions overlapping said article, and said shifting means being effective to cause said belts to move toward said article and thereby frictionally engage said article between said belts and said wheels for pulling and feeding said article from the stack.

7. Apparatus as defined in claim 6 wherein each of said shifting means includes a plurality of roller assemblies, each assembly comprising a gripper roller rotatably mounted on a movable shaft adjacent a corresponding said wheel, an idle roller rotatably mounted on a rotatable shaft, a take-up roller rotatably mounted on a movable shaft intermediate said gripper roller and said idle roller, articulated linkage means connecting said shaft for said idle roller to said shaft for said take-up roller and said shaft of said take-up roller to said shaft of said gripper roller, means for imparting rotary motion to said idle roller shaft causing said linkage means to move said gripper roller between said non-gripping position and said gripping position, and wherein each said belt is arranged on said rollers to move therewith.

8. Apparatus as defined in claim 3 wherein said shifting means includes a gripper roller rotatably mounted on a movable shaft adjacent said wheel, an idle roller rotatably mounted on a rotatable shaft, a take-up roller rotatably mounted on a movable shaft intermediate said gripper roller and said idle roller, articulated linkage means connecting said shaft for said idle roller to said shaft for said take-up roller and said shaft of said take-up roller to said shaft of said gripper roller, means for imparting rotary motion to said idle roller shaft causing said linkage means to move said gripper roller between said non gripping position and said gripping position, and wherein said belt is arranged on said rollers to move therewith.

9. The feeding apparatus of claim 2 wherein said linkage means includes a projection positioned to engage the end portion of said stack while the lowermost article is positioned adjacent said wheel for lifting the end portion of the stack to decrease the force needed to pull the lowermost article from the stack.

10. Apparatus as defined in claim 2 wherein said belt is effective to drive said wheel.

11. Apparatus as defined in claim 2 wherein said belt and said shifting means cooperate with said wheel to accommodate articles of different thickness.

* * * * *